US009016039B2

(12) United States Patent
Stoia et al.

(10) Patent No.: US 9,016,039 B2
(45) Date of Patent: Apr. 28, 2015

(54) COMBUSTOR AND METHOD FOR SUPPLYING FUEL TO A COMBUSTOR

(75) Inventors: Lucas John Stoia, Taylors, SC (US); Patrick Benedict Melton, Horse Shoe, NC (US); Bryan Wesley Romig, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 658 days.

(21) Appl. No.: 13/439,990

(22) Filed: Apr. 5, 2012

(65) Prior Publication Data

US 2013/0263571 A1 Oct. 10, 2013

(51) Int. Cl.

| | |
|---|---|
| ***F23R 3/34*** | (2006.01) |
| ***F23R 3/28*** | (2006.01) |
| ***F23R 3/14*** | (2006.01) |
| ***F23C 6/04*** | (2006.01) |
| *F23R 3/36* | (2006.01) |

(52) U.S. Cl.

CPC ..... *F23R 3/346* (2013.01); *F23R 3/286* (2013.01); *F23R 3/14* (2013.01); *F23R 3/36* (2013.01); *F23R 3/34* (2013.01); *F23C 6/047* (2013.01); *F23C 2201/30* (2013.01); *F23R 2900/03341* (2013.01)

(58) Field of Classification Search

CPC ..... F23R 3/14; F23R 3/346; F23R 3/286; F23R 3/34; F23R 2900/03341; F23R 3/36

See application file for complete search history.

(56) References Cited

U.S. PATENT DOCUMENTS

| | | | | | |
|---|---|---|---|---|---|
| 4,982,570 | A * | 1/1991 | Waslo et al. | ..... | 60/733 |
| 5,121,597 | A * | 6/1992 | Urushidani et al. | ..... | 60/778 |
| 5,127,221 | A * | 7/1992 | Beebe | ..... | 60/772 |
| 5,515,680 | A * | 5/1996 | Fujimura et al. | ..... | 60/737 |
| 5,778,676 | A * | 7/1998 | Joshi et al. | ..... | 60/746 |
| 5,901,555 | A * | 5/1999 | Mandai et al. | ..... | 60/747 |
| 6,122,916 | A * | 9/2000 | Amos et al. | ..... | 60/747 |
| 6,189,314 | B1 * | 2/2001 | Yamamoto et al. | ..... | 60/776 |
| 6,192,688 | B1 | 2/2001 | Beebe | | |
| 6,427,446 | B1 * | 8/2002 | Kraft et al. | ..... | 60/737 |
| 6,698,207 | B1 * | 3/2004 | Wiebe et al. | ..... | 60/737 |
| 7,707,833 | B1 * | 5/2010 | Bland et al. | ..... | 60/737 |
| 2001/0023590 | A1 * | 9/2001 | Mandai et al. | ..... | 60/747 |
| 2006/0183069 | A1 * | 8/2006 | Bernero et al. | ..... | 431/354 |
| 2008/0173019 | A1 * | 7/2008 | Kobayashi et al. | ..... | 60/739 |
| 2009/0282831 | A1 * | 11/2009 | Eroglu et al. | ..... | 60/737 |
| 2010/0146983 | A1 * | 6/2010 | Hellat et al. | ..... | 60/772 |
| 2010/0175382 | A1 * | 7/2010 | Eroglu | ..... | 60/748 |
| 2011/0225947 | A1 * | 9/2011 | Lacy et al. | ..... | 60/39.23 |
| 2012/0096866 | A1 * | 4/2012 | Khan et al. | ..... | 60/737 |
| 2014/0245738 | A1 * | 9/2014 | Crothers et al. | ..... | 60/725 |

* cited by examiner

*Primary Examiner* — William H Rodriguez
(74) *Attorney, Agent, or Firm* — Dority & Manning, P.A.

(57) ABSTRACT

A combustor includes a combustion chamber that defines a longitudinal axis. A primary reaction zone is inside the combustion chamber, and a secondary reaction zone inside the combustion chamber is downstream from the primary reaction zone. A center fuel nozzle extends axially inside the combustion chamber to the secondary reaction zone, and a plurality of fluid injectors circumferentially are arranged inside the center fuel nozzle downstream from the primary reaction zone. Each fluid injector defines an additional longitudinal axis out of the center fuel nozzle that is substantially perpendicular to the longitudinal axis of the combustion chamber.

20 Claims, 5 Drawing Sheets

COMBUSTOR AND METHOD FOR SUPPLYING FUEL TO A COMBUSTOR

FIELD OF THE INVENTION

The present invention generally involves a combustor and method for supplying fuel fluid to a combustor. In particular embodiments, a center fuel nozzle may supply a lean fuel-air mixture to the combustion chamber.

BACKGROUND OF THE INVENTION

Combustors are commonly used in industrial and power generation operations to ignite fuel to produce combustion gases having a high temperature and pressure. For example, gas turbines typically include one or more combustors to generate power or thrust. A typical gas turbine used to generate electrical power includes an axial compressor at the front, one or more combustors around the middle, and a turbine at the rear. Ambient air may be supplied to the compressor, and rotating blades and stationary vanes in the compressor progressively impart kinetic energy to the working fluid (air) to produce a compressed working fluid at a highly energized state. The compressed working fluid mixes with fuel before flowing into a combustion chamber where the fuel-air mixture ignites in a primary reaction zone to generate combustion gases having a high temperature and pressure. The combustion gases flow through a transition piece and into the turbine where they expand to produce work. For example, expansion of the combustion gases in the turbine may rotate a shaft connected to a generator to produce electricity.

Various design and operating parameters influence the design and operation of combustors. For example, higher combustion gas temperatures generally improve the thermodynamic efficiency of the combustor. However, higher combustion gas temperatures also promote flashback or flame holding conditions in which the combustion flame migrates towards the fuel being supplied by fuel nozzles, possibly causing severe damage to the fuel nozzles in a relatively short amount of time. In addition, higher combustion gas temperatures generally increase the disassociation rate of diatomic nitrogen, increasing the production of nitrogen oxides ($NO_X$). Conversely, a lower combustion gas temperature associated with reduced fuel flow and/or part load operation (turndown) generally reduces the chemical reaction rates of the combustion gases, increasing the production of carbon monoxide and unburned hydrocarbons.

In a particular combustor design, one or more late lean injectors or tubes may be circumferentially arranged around the combustion chamber downstream from the fuel nozzles. A portion of the compressed working fluid exiting the compressor may flow through the tubes to mix with fuel to produce a lean fuel-air mixture. The lean fuel-air mixture may then flow into a secondary reaction zone in the combustion chamber where the combustion gases from the primary reaction zone ignite the lean fuel-air mixture. The additional combustion of the lean fuel-air mixture raises the combustion gas temperature and increases the thermodynamic efficiency of the combustor.

Although the circumferentially arranged late lean injectors are effective at increasing combustion gas temperatures without producing a corresponding increase in the production of $NO_X$ emissions, liquid fuel supplied to the late lean injectors often results in excessive coking in the fuel passages. In addition, the circumferential delivery of the lean fuel-air mixture into the combustion chamber may also create localized hot streaks along the inside of the combustion chamber and transition piece that reduces the low cycle fatigue limit for these components. As a result, a combustor that can supply both liquid and gaseous fuel for late lean combustion without producing localized hot streaks along the inside of the combustion chamber and transition piece would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a combustion chamber that defines a longitudinal axis. A primary reaction zone is inside the combustion chamber, and a secondary reaction zone inside the combustion chamber is downstream from the primary reaction zone. A center fuel nozzle extends axially inside the combustion chamber to the secondary reaction zone, and a plurality of fluid injectors are circumferentially arranged inside the center fuel nozzle downstream from the primary reaction zone. Each fluid injector defines an additional longitudinal axis out of the center fuel nozzle that is substantially perpendicular to the longitudinal axis of the combustion chamber.

Another embodiment of the present invention is a combustor that includes a plurality of fuel nozzles and a combustion chamber downstream from the plurality of fuel nozzles, wherein the combustion chamber defines a longitudinal axis. A primary reaction zone is inside the combustion chamber adjacent to the plurality of fuel nozzles, and a secondary reaction zone inside the combustion chamber is downstream from the primary reaction zone. A center fuel nozzle extends axially inside the combustion chamber through the primary reaction zone, and a plurality of fluid injectors are circumferentially arranged inside the center fuel nozzle downstream from the primary reaction zone. Each fluid injector defines an additional longitudinal axis out of the center fuel nozzle that is substantially perpendicular to the longitudinal axis of the combustion chamber.

In a still further embodiment, the combustor includes an end cover that extends radially across at least a portion of the combustor, and a plurality of fuel nozzles are radially arranged in the end cover. A combustion chamber downstream from the end cover defines a longitudinal axis. A primary reaction zone is inside the combustion chamber adjacent to the fuel nozzles, and at least one fuel nozzle extends axially inside the combustion chamber downstream from the primary reaction zone. A plurality of fluid injectors are circumferentially arranged inside the at least one fuel nozzle downstream from the primary reaction zone, and each fluid injector defines an additional longitudinal axis out of the at least one fuel nozzle that is substantially perpendicular to the longitudinal axis of the combustion chamber.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
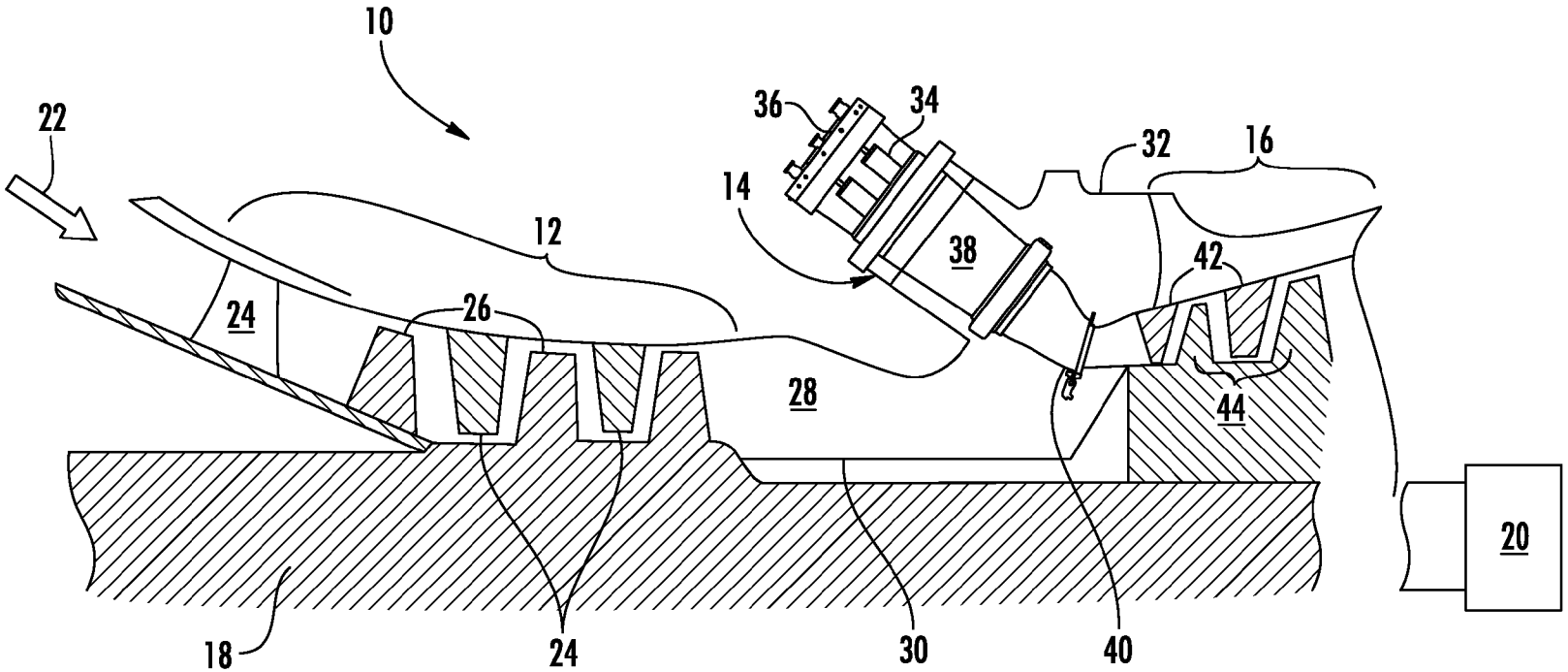
FIG. 1 is a simplified side cross-section view of an exemplary gas turbine.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "first", "second", and "third" may be used interchangeably to distinguish one component from another and are not intended to signify location or importance of the individual components. In addition, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for supplying fuel to a combustor. The combustor generally includes a combustion chamber with a primary reaction zone and a secondary reaction zone downstream from the primary reaction zone. A center fuel nozzle extends axially inside the combustion chamber, and a plurality of fluid injectors are circumferentially arranged inside the center fuel nozzle downstream from the primary reaction zone. Each fluid injector defines a longitudinal axis out of the center fuel nozzle that is substantially perpendicular to the longitudinal axis of the combustion chamber. In particular embodiments, the combustor may further include one or more fuel and/or fluid passages that provide fuel and/or working fluid to the fluid injectors. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

FIG. 1 provides a simplified cross-section of an exemplary gas turbine 10 that may incorporate various embodiments of the present invention. As shown, the gas turbine 10 may generally include a compressor 12 at the front, one or more combustors 14 radially disposed around the middle, and a turbine 16 at the rear. The compressor 12 and the turbine 16 typically share a common rotor 18 connected to a generator 20 to produce electricity.

The compressor 12 may be an axial flow compressor in which a working fluid 22, such as ambient air, enters the compressor 12 and passes through alternating stages of stationary vanes 24 and rotating blades 26. A compressor casing 28 contains the working fluid 22 as the stationary vanes 24 and rotating blades 26 accelerate and redirect the working fluid 22 to produce a continuous flow of compressed working fluid 22. The majority of the compressed working fluid 22 flows through a compressor discharge passage 30 to the combustor 14.

The combustor 14 may be any type of combustor known in the art. For example, as shown in FIG. 1, a combustor casing 32 may circumferentially surround some or all of the combustor 14 to contain the compressed working fluid 22 flowing from the compressor 12. One or more fuel nozzles 34 may be radially arranged in an end cover 36 to supply fuel to a combustion chamber 38 downstream from the fuel nozzles 34. Possible fuels include, for example, one or more of blast furnace gas, coke oven gas, natural gas, vaporized liquefied natural gas (LNG), hydrogen, and propane. The compressed working fluid 22 may flow from the compressor discharge passage 30 along the outside of the combustion chamber 38 before reaching the end cover 36 and reversing direction to flow through the fuel nozzles 34 to mix with the fuel. The mixture of fuel and compressed working fluid 22 flows into the combustion chamber 38 where it ignites to generate combustion gases having a high temperature and pressure. The combustion gases flow through a transition piece 40 to the turbine 16.

The turbine 16 may include alternating stages of stators 42 and rotating buckets 44. The first stage of stators 42 redirects and focuses the combustion gases onto the first stage of turbine buckets 44. As the combustion gases pass over the first stage of turbine buckets 44, the combustion gases expand, causing the turbine buckets 44 and rotor 18 to rotate. The combustion gases then flow to the next stage of stators 42 which redirects the combustion gases to the next stage of rotating turbine buckets 44, and the process repeats for the following stages.

Figure 2:
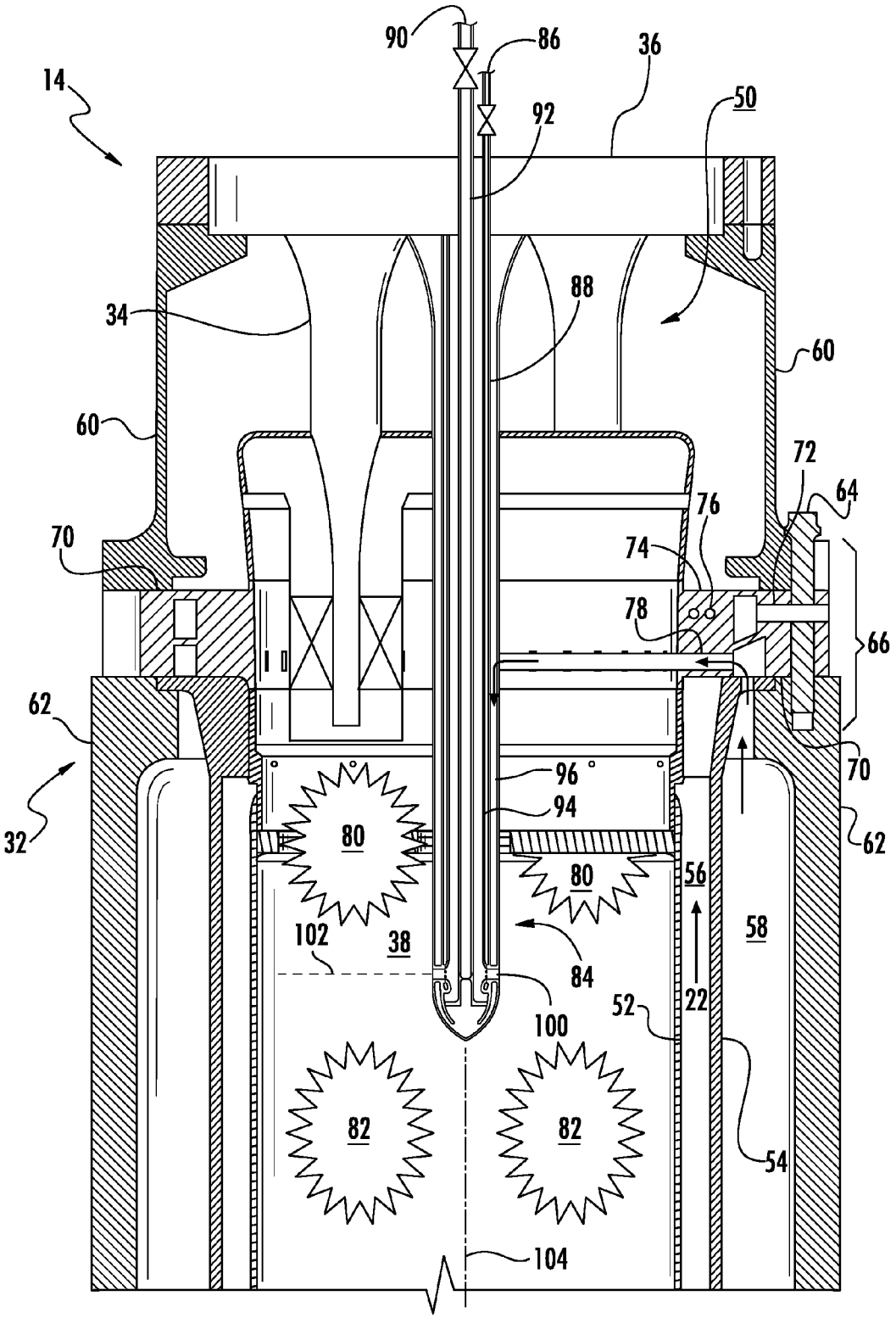
FIG. 2 is an enlarged side and partial cross-section view of the combustor shown in FIG. 1 according to a first embodiment of the present invention.

FIG. 2 provides an enlarged side view and partial cross-section of the combustor 14 shown in FIG. 1 according to a first embodiment of the present invention. As shown, the combustor casing 32 and end cover 36 define a volume 50, also referred to as the head end, inside the combustor 14, and a liner 52 circumferentially surrounds and defines at least a portion of the combustion chamber 38. A flow sleeve 54 may circumferentially surround at least a portion of the combustion chamber 38 to define an inner annular passage 56 between the liner 52 and the flow sleeve 54 and an outer annular passage 58 between the flow sleeve 54 and the casing 32. In this manner, the majority of the compressed working fluid 22 from the compressor 12 may flow through the inner annular passage 56 to provide convective cooling to the liner 24. When the compressed working fluid 22 reaches the head end or volume 50, the compressed working fluid 22 reverses direction to flow through the fuel nozzles 34 and into the combustion chamber 38.

The combustor casing 32 may include multiple annular sections that facilitate assembly and/or accommodate thermal expansion during operations. For example, as illustrated in the particular embodiment shown in FIG. 2, the combustor casing 32 may include a first annular casing 60 adjacent to the end cover 36 and a second annular casing 62 upstream from the first annular casing 60. A clamp, weld bead, and/or plurality of bolts 64 may circumferentially surround the combustor 14 to provide a connection or joint 66 between the first and second annular casings 60, 62.

In particular embodiments, a flange 70 may extend radially between the first and second annular casings 60, 62, and the flange 70 may include one or more internal fluid passages that provide fluid communication through the connection 66. For example, the flange 70 may include a fuel passage 72 that extends radially through the casing 32 to provide fluid communication through the casing 32 to the inner annular passage 56. A plurality of vanes 74 may circumferentially surround the combustion chamber 38 and extend radially in the annular passage 56 to guide the compressed working fluid 22 flow. In particular embodiments, the vanes 74 may be angled to impart swirl to the compressed working fluid 22 flowing through the inner annular passage 56. The flange 70 may connect to one or more of the vanes 74, and the fuel passage 72 may extend inside one or more of the vanes 74 so fuel may flow through quaternary fuel ports 76 in the vanes 74 to mix with the compressed working fluid 22 flowing through the inner annular passage 56. Alternately, or in addition, the flange 70 may include a diluent passage 78 that provides a fluid pathway for the compressed working fluid 22 to flow from the outer annular passage 58 into or around the fuel nozzles 34 before flowing into the combustion chamber 38.

As shown in FIG. 2, the fuel-air mixture flowing into the combustion chamber 38 ignites in a primary reaction zone 80 adjacent to the fuel nozzles 34. In addition, at least one fuel nozzle, such as the center fuel nozzle 84 shown in FIG. 2, extends axially inside the combustion chamber 38 through the primary reaction zone 80 to a secondary reaction zone 82. Various combinations of fuel and/or fluid passages may extend axially inside the center fuel nozzle 84. For example, as shown in the particular embodiment illustrated in FIG. 2, a gaseous fuel supply 86 may be connected to a gaseous fuel passage 88 that extends axially inside the center fuel nozzle 84, and/or a liquid fuel supply 90 may be connected to a liquid fuel passage 92 that extends axially inside the center fuel nozzle 84. Alternately or in addition, first and/or second fluid passages 94, 96 may extend axially inside the center fuel nozzle 84. Compressed working fluid 22 that flows through the inner annular passage 56 into the head end 50 may reverse direction and flow into the first fluid passage 94. In addition, cooler and higher pressure compressed working fluid 22 that flows through the outer annular passage 58 may flow through the diluent passage 78 and into the second fluid passage 96.

Figure 3:
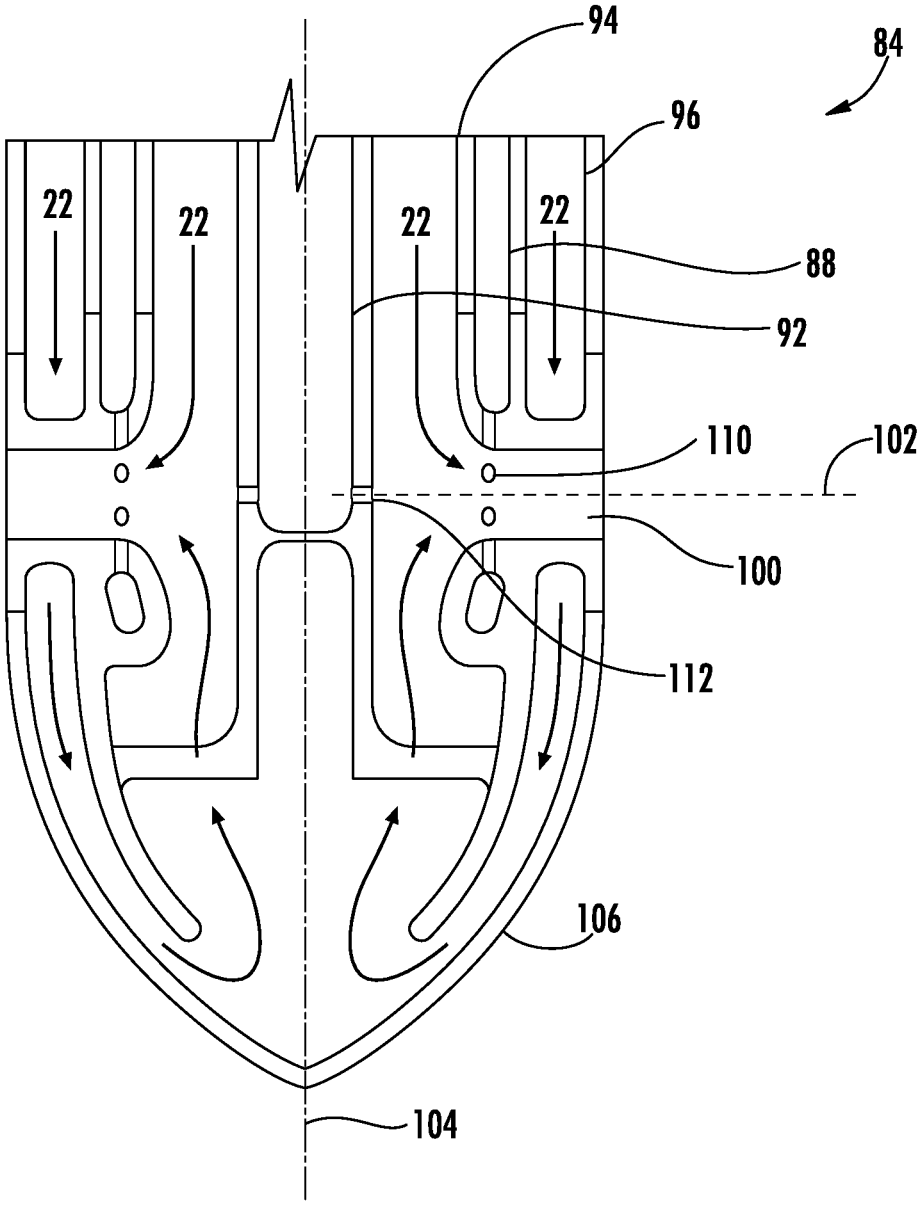
FIG. 3 is an enlarged side cross-section view of a portion of the center fuel nozzle shown in FIG. 2.

FIG. 3 provides an enlarged side cross-section view of a portion of the center fuel nozzle 84 shown in FIG. 2. As shown in FIGS. 2 and 3, a plurality of fluid injectors 100 are circumferentially arranged inside the center fuel nozzle 84 downstream from the primary reaction zone 80, and each fluid injector 100 defines a longitudinal axis 102 substantially perpendicular to a longitudinal axis 104 defined by the combustion chamber 38. As shown most clearly in FIG. 3, the compressed working fluid 22 flowing through the first fluid passage 94 may merge with the fluid injectors 100. In addition, the cooler and higher pressure compressed working fluid 22 flowing through the second fluid passage 96 may flow around the fluid injectors 100 and along a downstream surface 106 of the center fuel nozzle 84 to convectively cool the downstream surface 106 before also merging with the fluid injectors 100. The compressed working fluid 22 may then flow through fluid injectors 100 substantially normal to the flow of combustion gases inside the combustion chamber 38 to enhance mixing between the compressed working fluid 22 and the combustion gases to quench the combustion gases downstream from the primary reaction zone 80.

When desired, gaseous and/or liquid fuel may be supplied through the gaseous and liquid fuel passages 88, 92, respectively, to increase the combustion gas temperature. As shown most clearly in FIG. 3, at least a portion of the gaseous fuel passage 88 may circumferentially surround one or more of the fluid injectors 100, and a plurality of fuel ports 110 may provide fluid communication between the gaseous fuel passage 88 and one or more of the fluid injectors 100 inside the center fuel nozzle 84. Alternately or in addition, a plurality of fuel ports 112 may provide fluid communication between the liquid fuel passage 92 and one or more of the fluid injectors 100 inside the center fuel nozzle 84. In this manner, gaseous and/or liquid fuel may mix with the compressed working fluid 22 supplied by the first and/or second fluid passages 94, 96 inside the fluid injectors 100 to form a lean fuel-air mixture. The fluid injectors 100 may then inject the lean fuel-air mixture substantially normal to the flow of combustion gases inside the combustion chamber 38 to enhance mixing between the lean fuel-air mixture and the combustion gases, and the combustion gases ignite the lean fuel-air mixture in the secondary reaction zone 82 to increase the combustion gas temperature. In addition, the injection of the lean fuel-air mixture from the center fuel nozzle 84 obviates the formation of localized hot streaks along the inside of the combustion chamber 38 and transition piece 40.

Figure 4:
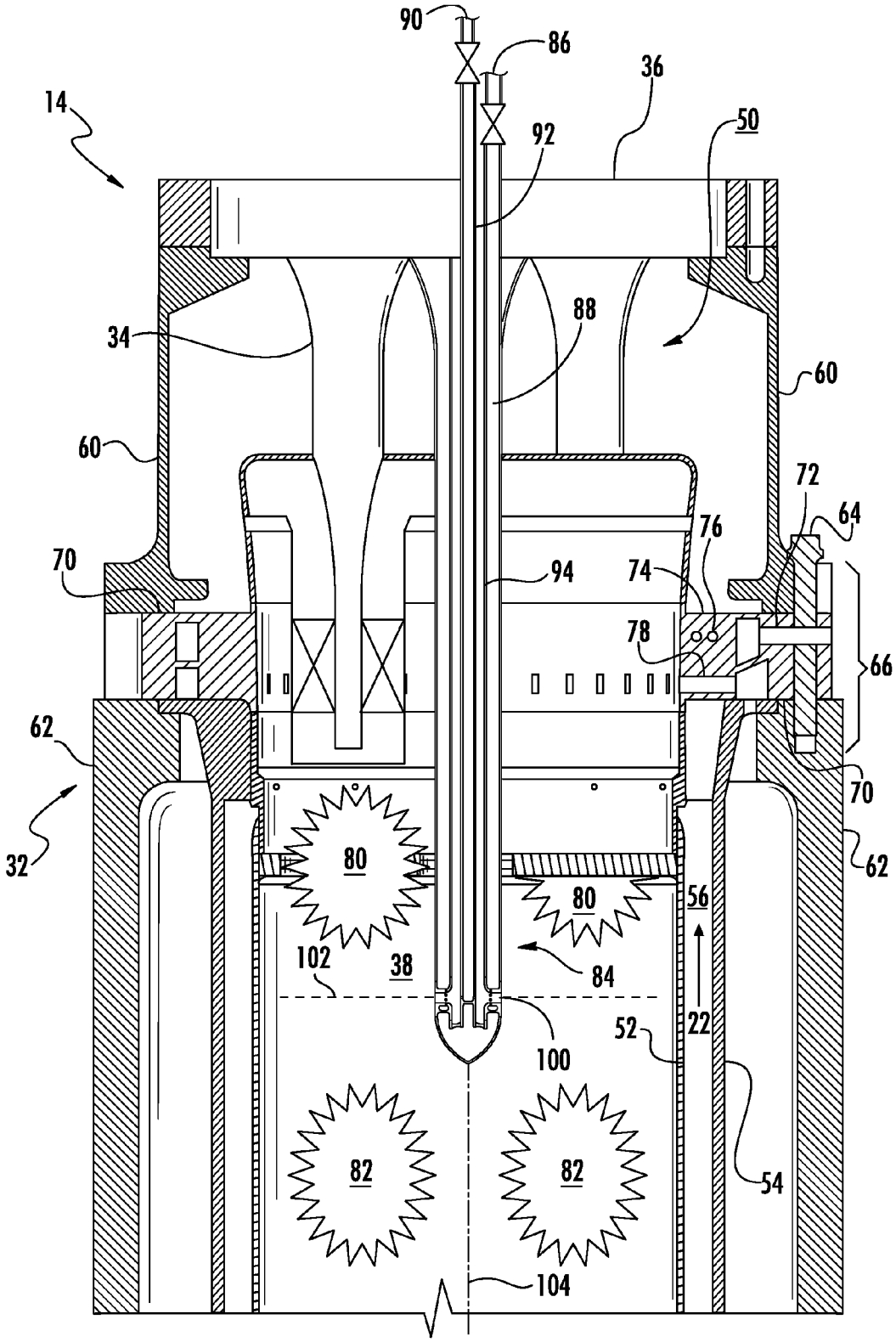
FIG. 4 is an enlarged side and partial cross-section view of the combustor shown in FIG. 1 according to a second embodiment of the present invention.
Figure 5:
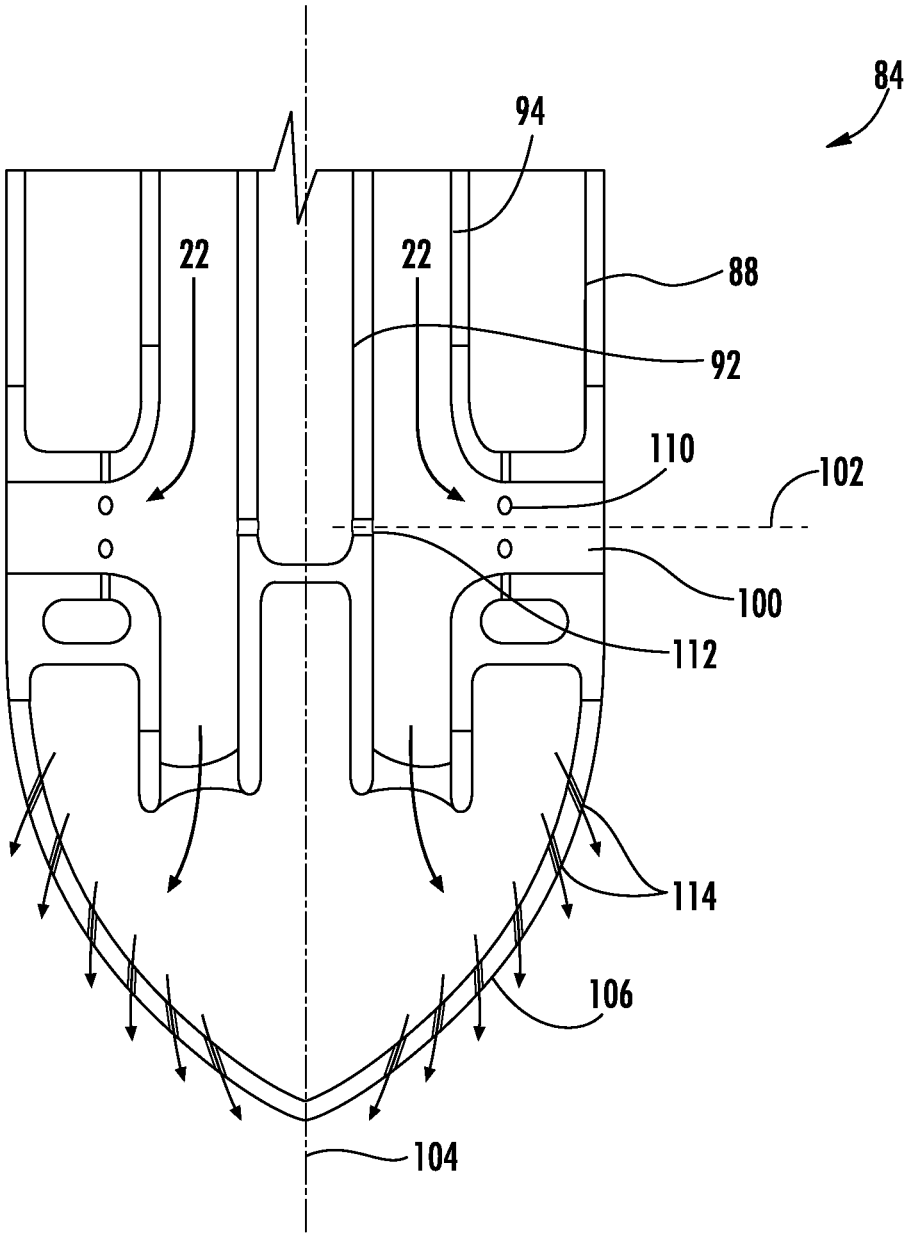
FIG. 5 is an enlarged side cross-section view of a portion of the center fuel nozzle shown in FIG. 4.

FIG. 4 provides an enlarged side and partial cross-section view of the combustor 14 shown in FIG. 1 according to a second embodiment of the present invention, and FIG. 5 provides an enlarged side cross-section view of a portion of the center fuel nozzle 84 shown in FIG. 4. As shown in FIG. 4, the combustor 14 again includes the casing 32, fuel nozzles 34, liner 52, flow sleeve 54, and inner annular passage 56 as previously described with respect to the embodiment shown in FIG. 2. In addition, the center fuel nozzle 84 again extends inside the combustion chamber 38 through the primary reaction zone 80 and includes the gaseous and liquid fuel passages 88, 92, fluid injectors 100, and fuel ports 110, 112 as previously described. In this particular embodiment, as shown most clearly in FIG. 5, a plurality of fluid ports 114 through the downstream surface 106 are in fluid communication with the first fluid passage 94. As a result, a portion of the compressed working fluid 22 flowing through the first fluid passage 94 may flow through the fluid ports 114 to provide effusion cooling to the downstream surface 106 of the center fuel nozzle 84.

One of ordinary skill in the art will readily appreciate from the teachings herein that the various embodiments shown and described with respect to FIGS. 2-5 may also provide a method for supplying fuel to the combustor 14. The method may include, for example, supplying at least one of liquid or gaseous fuel through the center fuel nozzle 84 that extends axially inside the combustion chamber 38 through the primary reaction zone 80. In addition, the method may include mixing the liquid and/or gaseous fuel with the working fluid 22 inside the center fuel nozzle 84 to create the lean fuel-air mixture and injecting the fuel-air mixture substantially normal to the flow of combustion gases through the combustion chamber 38. In particular embodiments, the first fluid passage 94 may provide fluid communication between the inner annular passage 56 and one or more of the fluid injectors 100 inside the center fuel nozzle 84 and/or the second fluid passage 96 may provide fluid communication between the outer annular passage 58 and one or more of the fluid injectors 100 inside the center fuel nozzle 84. As a result, the various embodiments described herein may supply liquid and/or gaseous fuel for late lean combustion to enhance combustor 14 efficiency without producing a corresponding increase in $NO_X$ emissions. In addition, the various embodiments described herein avoid creating localized hot streaks along the inside of the combustion chamber 38 and transition piece 40 that may reduce the low cycle fatigue limit for these components.

This written description uses examples to disclose the invention, including the best mode, and also to enable any person skilled in the art to practice the invention, including making and using any devices or combustors and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. a combustion chamber that defines a longitudinal axis;

b. a primary reaction zone inside the combustion chamber;

c. a secondary reaction zone inside the combustion chamber downstream from the primary reaction zone;

d. a center fuel nozzle that extends axially inside the combustion chamber to the secondary reaction zone; and e. a plurality of fluid injectors circumferentially arranged inside the center fuel nozzle downstream from the primary reaction zone, wherein each fluid injector defines an additional longitudinal axis out of the center fuel nozzle that is substantially perpendicular to the longitudinal axis of the combustion chamber.

2. The combustor as in claim 1, further comprising:

a. a first fuel passage that extends axially inside the center fuel nozzle;

b. a gaseous fuel supply connected to the first fuel passage; and c. a plurality of fuel ports that provides fluid communication between the first fuel passage and one or more of the fluid injectors inside the center fuel nozzle.

3. The combustor as in claim 2, wherein at least a portion of the first fuel passage circumferentially surrounds one or more of the fluid injectors.

4. The combustor as in claim 1, further comprising:

a. a second fuel passage that extends axially inside the center fuel nozzle;

b. a liquid fuel supply connected to the second fuel passage; and c. a plurality of fuel ports that provides fluid communication between the second fuel passage and one or more of the fluid injectors inside the center fuel nozzle.

5. The combustor as in claim 1, further comprising:

a. a casing that circumferentially surrounds at least a portion of the combustion chamber;

b. a flow sleeve between the casing and the combustion chamber that defines an inner annular passage between the combustion chamber and the flow sleeve and an outer annular passage between the flow sleeve and the casing; and c. a first fluid passage that extends axially inside the center fuel nozzle and provides fluid communication between the inner annular passage and one or more of the fluid injectors inside the center fuel nozzle.

6. The combustor as in claim 5, further comprising a downstream surface of the center fuel nozzle and a plurality of fluid ports through the downstream surface in fluid communication with the first fluid passage inside the center fuel nozzle.

7. The combustor as in claim 5, further comprising a second fluid passage that extends axially inside the center fuel nozzle and provides fluid communication between the outer annular passage and one or more of the fluid injectors inside the center fuel nozzle.

8. A combustor, comprising:

a. a plurality of fuel nozzles;

b. a combustion chamber downstream from the plurality of fuel nozzles, wherein the combustion chamber defines a longitudinal axis;

c. a primary reaction zone inside the combustion chamber adjacent to the plurality of fuel nozzles;

d. a secondary reaction zone inside the combustion chamber downstream from the primary reaction zone;

e. a center fuel nozzle that extends axially inside the combustion chamber through the primary reaction zone; and f. a plurality of fluid injectors circumferentially arranged inside the center fuel nozzle downstream from the primary reaction zone, wherein each fluid injector defines an additional longitudinal axis out of the center fuel nozzle that is substantially perpendicular to the longitudinal axis of the combustion chamber.

9. The combustor as in claim 8, further comprising:

a. a first fuel passage that extends axially inside the center fuel nozzle;

b. a gaseous fuel supply connected to the first fuel passage; and c. a plurality of fuel ports that provides fluid communication between the first fuel passage and one or more of the fluid injectors inside the center fuel nozzle.

10. The combustor as in claim 9, wherein at least a portion of the first fuel passage circumferentially surrounds one or more of the fluid injectors.

11. The combustor as in claim 9, further comprising:

a. a second fuel passage that extends axially inside the center fuel nozzle;

b. a liquid fuel supply connected to the second fuel passage; and c. a plurality of liquid fuel ports that provides fluid communication between the second fuel passage and one or more of the fluid injectors inside the center fuel nozzle.

12. The combustor as in claim 8, further comprising:

a. a casing that circumferentially surrounds at least a portion of the combustion chamber;

b. a flow sleeve between the casing and the combustion chamber that defines an inner annular passage between the combustion chamber and the flow sleeve and an outer annular passage between the flow sleeve and the casing; and c. a first fluid passage that extends axially inside the center fuel nozzle and provides fluid communication between the inner annular passage and one or more of the fluid injectors inside the center fuel nozzle.

13. The combustor as in claim 12, further comprising a downstream surface of the center fuel nozzle and a plurality of fluid ports through the downstream surface in fluid communication with the first fluid passage inside the center fuel nozzle.

14. The combustor as in claim 12, further comprising a second fluid passage that extends axially inside the center fuel nozzle and provides fluid communication between the outer annular passage and one or more of the fluid injectors inside the center fuel nozzle.

15. A combustor, comprising:

a. an end cover that extends radially across at least a portion of the combustor;

b. a plurality of fuel nozzles radially arranged in the end cover;

c. a combustion chamber downstream from the end cover, wherein the combustion chamber defines a longitudinal axis;

d. a primary reaction zone inside the combustion chamber adjacent to the fuel nozzles, wherein at least one fuel nozzle extends axially inside the combustion chamber downstream from the primary reaction zone; and e. a plurality of fluid injectors circumferentially arranged inside the at least one fuel nozzle downstream from the primary reaction zone, wherein each fluid injector defines an additional longitudinal axis out of the at least one fuel nozzle that is substantially perpendicular to the longitudinal axis of the combustion chamber.

16. The combustor as in claim 15, further comprising a liquid fuel passage that extends axially inside the at least one fuel nozzle and provides fluid communication for a liquid fuel to flow into one or more of the fluid injectors.

17. The combustor as in claim 16, further comprising a gaseous fuel passage that extends axially inside the at least one fuel nozzle and provides fluid communication for a gaseous fuel to flow into one or more of the fluid injectors.

18. The combustor as in claim 17, wherein at least a portion of the gaseous fuel passage circumferentially surrounds one or more of the fluid injectors.

19. The combustor as in claim 15, further comprising:

a. a casing that circumferentially surrounds at least a portion of the combustion chamber;

b. a flow sleeve between the casing and the combustion chamber that defines an inner annular passage between the combustion chamber and the flow sleeve and an outer annular passage between the flow sleeve and the casing; and c. a first fluid passage that extends axially inside the at least one fuel nozzle and provides fluid communication between the outer annular passage and one or more of the fluid injectors inside the at least one fuel nozzle.

20. The combustor as in claim 19, further comprising a second fluid passage that extends axially inside the at least one fuel nozzle and provides fluid communication between the inner annular passage and one or more of the fluid injectors inside the at least one fuel nozzle.

* * * * *